US005348498A

United States Patent [19]

Morello et al.

[11] Patent Number: 5,348,498

[45] Date of Patent: Sep. 20, 1994

[54] SEALED PASS THROUGH ELECTRICAL CONNECTOR

[75] Inventors: John R. Morello, Lake Milton; James A. Okrucky, Warren; Frank T. Neale, Fowler, all of Ohio

[73] Assignee: General Motors Corporation, Detroit, Mich.

[21] Appl. No.: 77,589

[22] Filed: Jun. 17, 1993

Related U.S. Application Data

[62] Division of Ser. No. 956,217, Oct. 5, 1992, Pat. No. 5,252,088.

[51] Int. Cl.[5] ..... H01R 4/10

[52] U.S. Cl. ..... 439/877; 439/891

[58] Field of Search ..... 439/271, 891, 877–883, 439/885, 692

[56] References Cited

U.S. PATENT DOCUMENTS

| | | | |
|---|---|---|---|
| 2,748,367 | 3/1956 | Schelke et al. | 439/879 |
| 2,881,406 | 4/1959 | Arson | 339/59 |
| 3,643,206 | 2/1972 | Cowmeadow | 339/94 R |
| 3,721,943 | 3/1973 | Curr | 439/877 |
| 3,970,352 | 7/1976 | Dowell et al. | 439/276 |
| 4,209,221 | 6/1980 | Chupak et al. | 339/223 S |
| 4,434,552 | 3/1984 | Brush, Sr. et al. | 439/891 |
| 4,479,691 | 10/1984 | Smith, Jr. | 439/271 |
| 4,492,421 | 1/1985 | Ito | 339/59 R |
| 4,527,851 | 7/1985 | Gallusser et al. | 439/271 |
| 4,729,743 | 3/1988 | Farrar et al. | 439/276 |
| 4,784,617 | 11/1988 | Oda | 439/595 |
| 4,859,197 | 8/1989 | Toramoto et al. | 439/675 |
| 4,913,678 | 3/1990 | Avellino et al. | 439/891 |
| 4,995,836 | 2/1991 | Toramoto | 439/675 |
| 5,035,655 | 7/1991 | Hesse | 439/699 |
| 5,100,346 | 3/1992 | McCardell | 439/595 |

*Primary Examiner*—David L. Pirlot
*Attorney, Agent, or Firm*—William A. Schuetz

[57] ABSTRACT

Electric cables are passed through a hole in a transmission housing that is filled with transmission fluid by means of a sealed electrical connector system that comprises a sealed "pass through" electrical connector that is mounted in the hole of the transmission housing and an external mating connector. The pass through connector includes an insert that cooperates with solid metal pins of specially designed two-piece male terminals to seal the mating end of the pass through connector. The insert also serves as a secondary lock to insure that the male terminals are retained in the terminal cavities. The external mating connector also has an insert that has the same secondary lock feature to retain female terminals in its terminal cavities.

2 Claims, 6 Drawing Sheets

SEALED PASS THROUGH ELECTRICAL CONNECTOR

This is a division of application Ser. No. 07/956,217 filed on Oct. 5, 1992, now U.S. Pat. No. 5,252,088.

BACKGROUND OF THE INVENTION

This invention relates generally to electrical connectors and more particularly to sealed electrical connectors that pass through a housing that is filled with a liquid, such as a automotive transmission housing that is filled with transmission fluid.

Electronically controlled transmissions require electrical power and signal communication between exterior electrical devices and electrical components inside the transmission housing which is achieved by electrical cables passing through a hole in the transmission housing. The transmission housings are filled with transmission fluid which makes it difficult to seal the hole because the internal geometry of the electric cables inside the housing produce a wicking and/or capillary effect that brings the transmission fluid to the seal faces.

Presently, electric cables are passed into the transmission housing through a hole in a wall of the transmission housing by a sealed electrical connector system. This system comprises a "pass-through" electrical connector that is mounted in the hole in the transmission housing wall and contains male terminals of the contact blade type. The male terminals are attached to the ends of the electric cables inside the transmission housing with their flat and relatively wide contact blades positioned outside the transmission housing. An external electrical connector that contains mating female terminals attached to the ends of the external electrical cables is then simply plugged on the "pass-through" electrical connector to interconnect the internal and external cables.

The transmission wall hole is sealed off by a rubber O-ring seal carried by the pass-through connector. The pass-through electrical connector itself is sealed by two serially arranged seals. First, a cable seal seals around the internal electric cables at the cable end of the connector body that is inside the transmission housing. Then a face seal seals around the flat wide contact blades at the mating end of the connector body that is outside the transmission housing.

This present system is very difficult to seal effectively even though it has two serially arranged seals because of the wicking and/or capillary action of the electric cables inside the fluid filled transmission housing. Due to this wicking and/or capillary action the transmission fluid travels along the interior of the electric cables and tends to leak through the cable seal into the terminal cavity of the pass-through connector, travel along the terminal and then leak through the face seal to the exterior of the transmission housing. Fluid tight sealing at the face seal is particularly difficult to achieve because the flat wide contact blades of the male terminals protrude through the face seal for insertion into the mating female terminals when the external electrical connector is plugged on.

SUMMARY OF THE INVENTION

The object of this invention is to provide an improved sealed pass-through electrical connector for a fluid filled housing that is fluid tight even when the fluid travels along the cable interior inside the transmission housing by wicking and/or capillary action.

A feature of the invention is that the improved sealed pass-through electrical connector has improved sealing without any need for a cable seal that may be eliminated.

Another feature of the invention is that the improved sealed pass-through electrical connector has a protruding male terminal and face seal that are configured to provide a leak proof interface that stops leakage of fluid traveling along the male terminal.

Still another feature of the invention is that the improved sealed pass-through electrical connector has a face seal which also provides an interface seal when the external electrical connector is plugged onto the pass-through electrical connector.

Yet still another feature of the invention is that the improved sealed pass-through electrical connector has a face seal that is part of an insert that also provides a secondary lock for retaining the male terminals in the pass through electrical connectors.

In another aspect the invention provides an improved electrical connector that has a secondary lock for retaining electric terminals in electrical connectors that also applies to the external electrical connector.

In yet another aspect the invention provides an improved male terminal that is especially useful for use in sealed electrical connectors that have a face seal that seals around protruding portions of the terminal.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
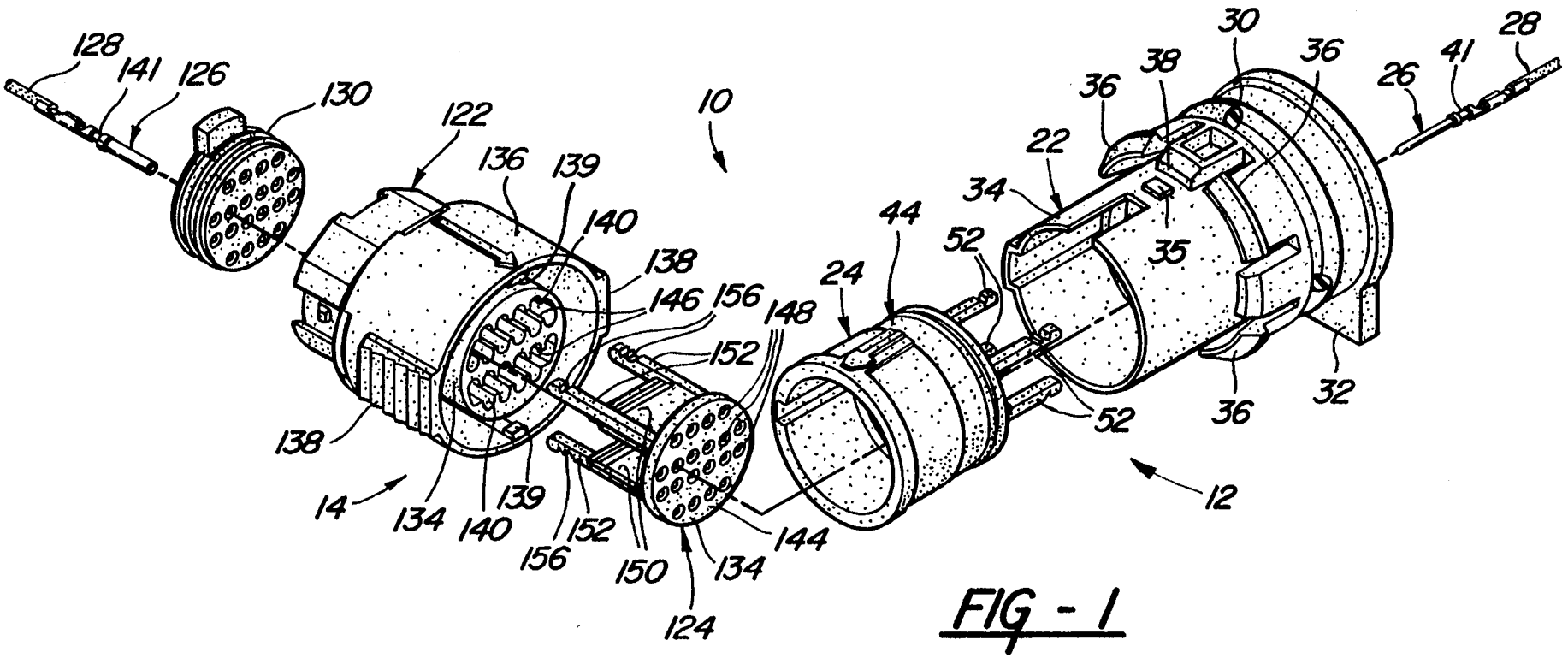
FIG. 1 is an exploded isometric view of a sealed pass-through electrical connector of this invention and a mating electrical connector.
Figure 2:
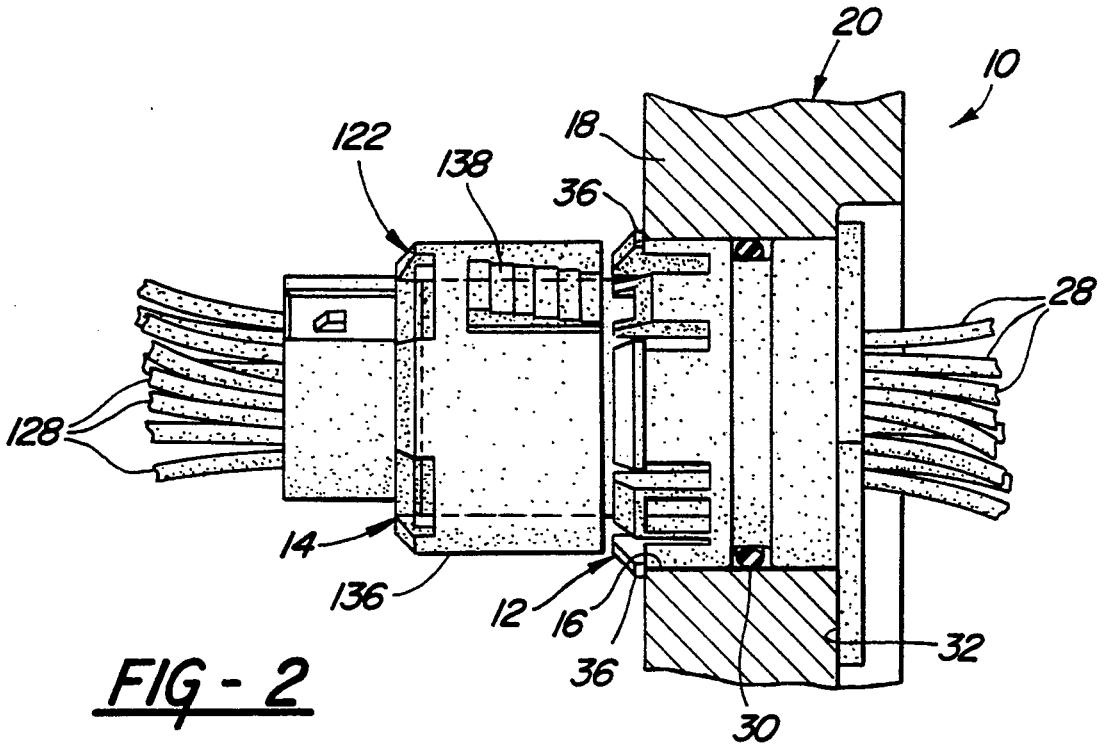
FIG. 2 is a longitudinal side view of the sealed pass-through electrical connector of this invention installed in a transmission housing wall and connected to the mating electrical connector shown in FIG. 1.

Referring now to the drawing, a sealed pass-through electrical connector system, indicated generally at 10 in FIG. 1 comprises a sealed pass-through electrical connector 12 and an external mating electrical connector 14. As shown in FIG. 2, the sealed pass-through electrical connector 12 is installed in a hole 16 through a wall 18 of a liquid filled housing 20, such as a transmission housing that is filled with transmission fluid. The external electrical connector 14 is plugged into the installed pass-through electrical connector 12 to make several electrical connections between internal and external electric cables that are part of the operating and control system of an electronically controlled transmission.

The sealed pass-through electrical connector 12 comprises a thermoplastic connector body 22, an insert 24, a plurality of male terminals 26 that are attached to electric cables 28 and a rubber O-ring seal 30.

The connector body 22 has a flange 32 at the cable end where the electric cables 28 exit and a socket 34 at the mating end where the mating electrical connector 14 is plugged in. The medial portion of the connector body 22 has four circumferentially spaced, resiliently deflectable lock fingers 36 and four lugs 38 that are interdigitated with the lock fingers 36. The pass through connector 12 is installed in the transmission wall 16 by inserting the pass through connector 12 through the hole 16 from inside the transmission housing 20. The connector 14 is locked in place by the flange 32 engaging an interior surface of the transmission housing 20 around the hole 16 and the lock fingers 36 engaging an exterior surface of the transmission housing 20 around the hole 16 as shown in FIG. 2. When the pass-through connector 12 is installed, the connector body 22 is centered by the lugs 38 and the hole 16 is sealed by the rubber O-ring seal 30 that is carried in an external groove of the connector body 32.

Figure 3:
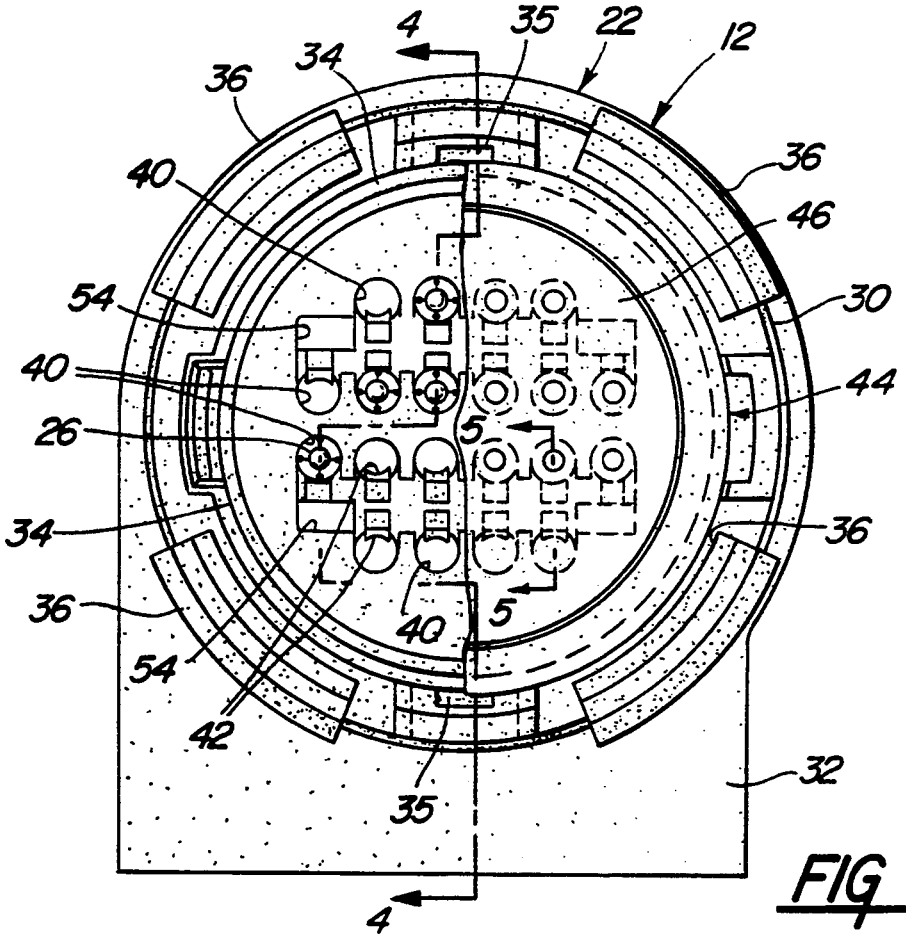
FIG. 3 is a front, partially sectioned view of the sealed pass-through electrical connector that is shown in FIGS. 1 and 2.
Figure 4:
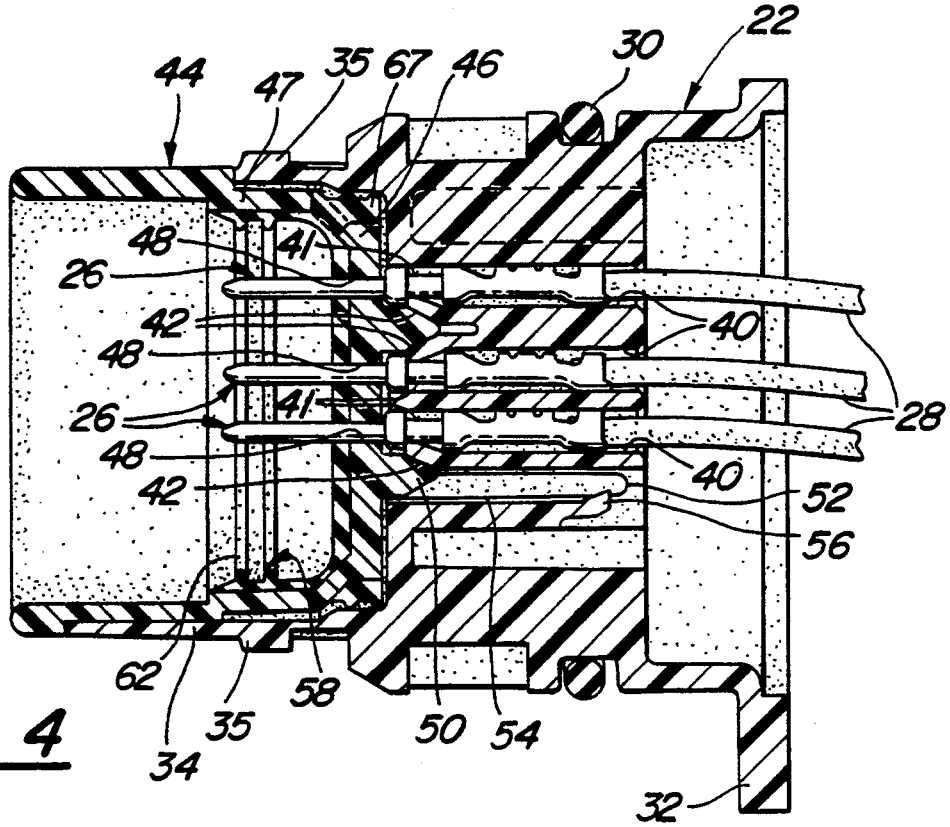
FIG. 4 is a section taken substantially along the line 4—4 of FIG. 3 looking in the direction of the arrows.

The connector body 22 also includes a plurality of terminal cavities 40 that are arranged in four rows as shown in FIG. 3 and that extend through the connector body 22 in the longitudinal direction as shown in FIG. 4. The connector body 22 also has a plurality of resiliently deflectable, latch fingers 42 that are located at the mating ends of the respective terminal cavities 40. When the terminals 26 are inserted into the terminal cavities 40 through the cable end, the latch fingers 42 snap into circular grooves 41 of the terminals 26 to retain the terminals 26 in the cavities 40 as shown in FIGS. 4 and 5.

Figure 5:
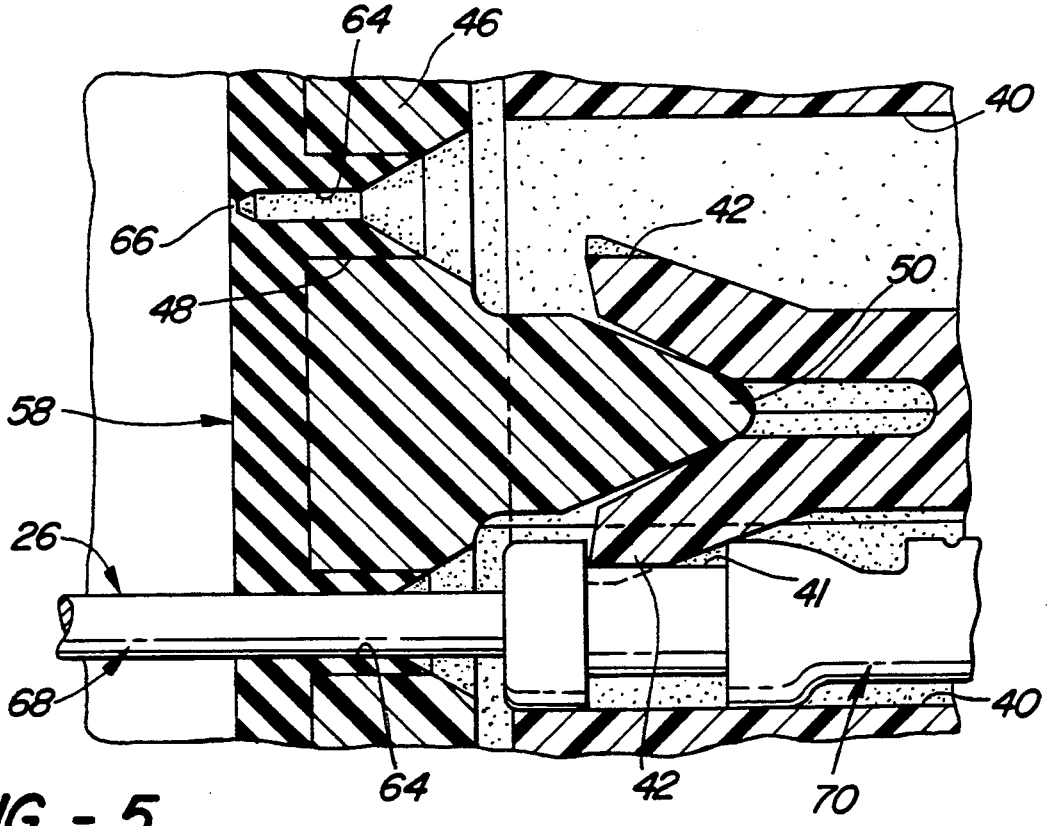
FIG. 5 is an enlargement of a portion of FIG. 4.

The latch fingers 42 are also arranged in two dual rows so that two rows of latch fingers 42 are disposed between the upper two rows of terminal cavities 40 and two rows of latch fingers 42 are disposed between the lower two rows of latch fingers 42 as shown in FIGS. 3, 4 and 5. This facilitates a secondary lock for holding the latch fingers 42 in the grooves 41 as explained below.

The insert 24 has several functions. It provides a face seal for sealing the mating ends of the terminal cavities 40 at the mating end of the connector body 22. It provides a perimeter face seal for sealing around the solid metal pins of the male terminals 26. It provides an interface seal for sealing the interface between the pass-through connector 12 and the exterior plug-in connector 14. And it provides a secondary lock for holding the latch fingers 42 in terminal latching positions in the grooves 41 of the male terminals 26.

The insert 24 comprises a thermoplastic body in the form of a cup 44 that fits into the socket 34 of the connector body 22 as best shown in FIGS. 3 and 4. The bottom deck 46 of the cup 44 has a plurality of holes 48 that align with the respective terminal cavities 40 when the insert is installed. The disk 46 also has two transverse wedge shaped ribs 50. Each wedge shaped rib 50 engages between the two rows of terminal latch fingers 42 in each dual row and function to wedge the terminal latch fingers 42 in the two rows away from each other to hold the latch fingers 42 in the terminal grooves 41 as best shown in FIGS. 4 and 5.

The insert 24 also has four rectangular posts 52 that extend longitudinally from the disc 46 in the rearward direction. These posts 52 are disposed in rectangular passages 54 of the connector body 22 that have resiliently deflectable latch fingers 56 at the cable end. The deflectable latch fingers 56 engage notches in the free ends of the posts 52 to retain the insert 24 in the socket 34 as shown in FIG. 4.

The insert 24 further comprises a molded on seal 58 of elastomeric material, preferably a 20 durometer fluorosilicone that adheres to the solid metal pins of the male terminals 26 and resist the deleterious effects of transmission fluid. The seal 58 comprises an internal portion that includes a face seal 60 that covers the disc 46 and a contiguous peripheral seal 62 that covers the inside of the peripheral wall 47 of the cup 44 for a short distance as shown in FIG. 4. The face seal 60 has button portions disposed in the holes 48 sealing around the solid metal pins of the male terminals 26 when the male terminals 26 are locked in the terminal cavities 40 as shown in FIGS. 4 and 5. The button portions have holes 64 that extend part way through the face seal. These holes 64 include sealing portions that have a diameter that is smaller than the diameter of the solid metal pins so that a liquid tight seal is formed around the solid metal pins when they are pushed through the holes 64. The mating ends of the holes 64 are preferably closed by thin membranes 66 that seal empty terminal cavities but that are easily pierced by the solid metal pins of the male terminals 26 that are in the used terminal cavities 40.

The seal 58 further comprises an external annular portion 67 around the disk 46 that forms a peripheral seal between the insert 24 and inside of the socket 38 of the connector body 22 when the insert 24 is installed in the connector body 22.

The typical male terminal 26 is shown in detail in FIGS. 8, 9, 10, 11 and 12. It is of two piece construction comprising a contact member 68 and an attachment member 70, both of which are made of an electrically conductive material, such as brass. The contact member 68 has a round solid pin 72 at one end that has a round point to facilitate insertion of the male terminal into the terminal cavities 40 and through the sealing holes 64 and membranes 66 of the insert 24.

Figure 8:
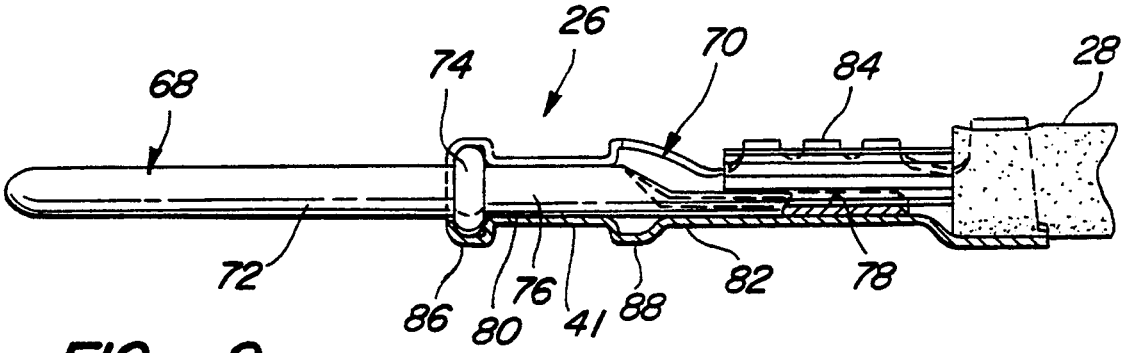
FIG. 8 is a longitudinal, partially sectioned, side view of a two-piece male terminal that is used in the sealed pass-through electrical connector that is shown in FIGS. 1, 2, 3 and 4.

While the medial portion of the contact member 26 has an integral collar 74 the opposite end has a round clamping section 76 behind the collar 74 and a flattened dished end 78 that is knurled on its upper concave surface. The integral collar 74 and clamping section 76 are used for securing the contact member 72 and the attachment member 68 together. The flattened dished end 78 is used to establish good electrical contact between the contact member 68 and the conductive core of the electrical conductor wire 28 when the male terminal 26 is attached to the insulation stripped end of the cable 28 as shown in FIG. 8.

Figure 9:
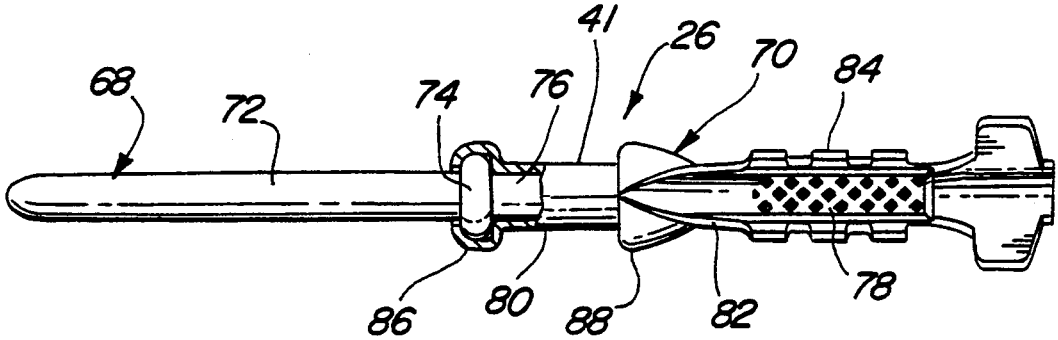
FIG. 9 is a top view of the two-piece male terminal shown in FIG. 8 before it is attached to an electric cable.
Figure 10:
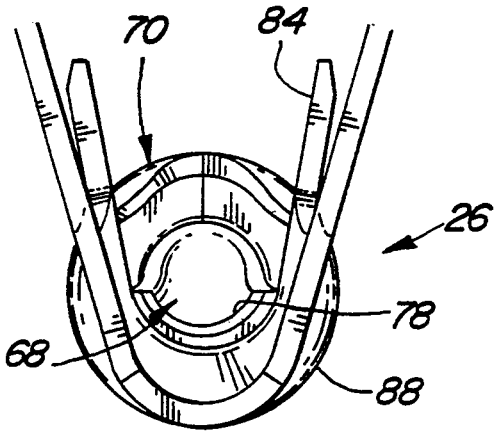
FIG. 10 is an end view of the two-piece male terminal shown in FIG. 8 before it is attached to an electric cable.
Figure 11:
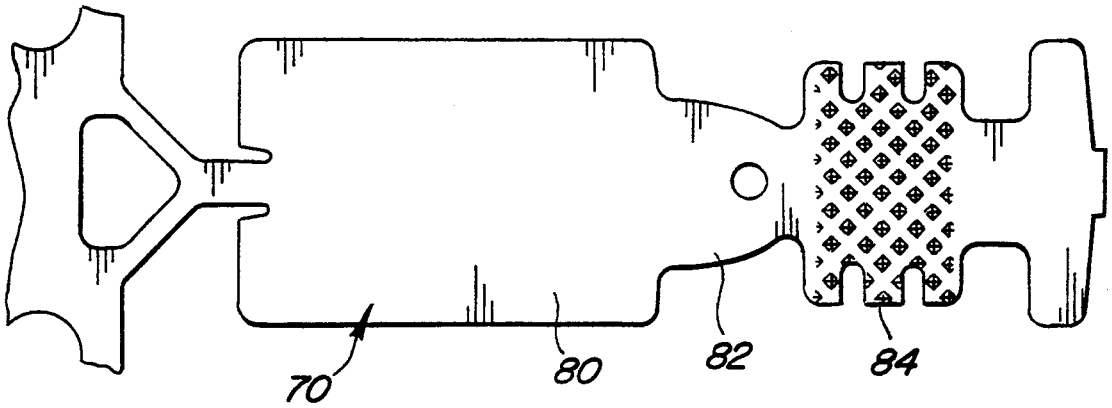
FIG. 11 is a plan view of the blank for making one piece of the two-piece male terminal that is shown in FIGS. 8, 9 and 10.
Figure 12:
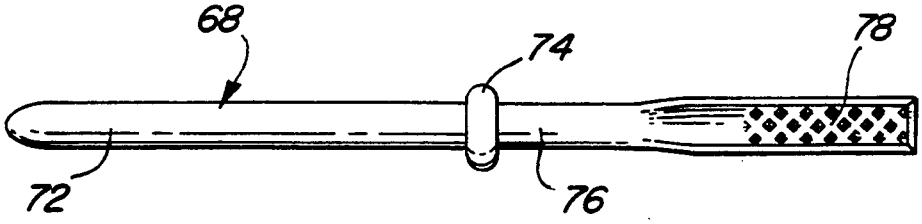
FIG. 12 is a top view of the other piece of the two-piece male terminal that is shown in FIGS. 8, 9 and 10.

The attachment member 70 is a sheet metal stamping blank that has a generally rectangular attachment portion 80 at one end, a medial transition neck 82 and a conventional core and insulation crimp portion 84 at the other end. The attachment portion 80 is rolled into a cylinder having a hollow circular rib 86 at one end that is formed around the collar 74 and a hollow circular rib 88 at the other end that is spaced from the hollow circular rib 86 to form the circular groove 41 that is used to lock the male terminal 26 in the connector body 22. The section of the rolled attachment portion 80 between the hollow ribs 86 and 88 clamps around the clamping section 76 of the contact member 68 tightly. The core and insulation crimp portion 84 of the blank is conventionally formed as an open U-shaped channel as shown in FIGS. 9 and 10. The flattened dished end 78 of the contact member 68 lies in the bottom of the channel when the attachment member 70 is attached to the contact member 68 so that the core of the electric cable 28 is pressed against the upper knurled surface of the flattened dished end 78 when the channel is crimped about the cable 28 as shown in FIG. 8.

The external mating connector 14 is shown in FIGS. 1, 2, 6 and 7.

The external mating connector 14 comprises a thermoplastic connector body 122, a thermoplastic insert 124, a plurality of female terminals 126 that are attached to electric cable 128 and a rubber cable seal 130.

The connector body 122 has a seal cavity 132 at the cable end where the electric cable 128 exit and a plug 134 at the mating end where it plugs into the pass-through connector 12. An oval shaped lock sleeve 136 that is disposed around the plug 134 in a radially spaced relationship is attached to the medial portion of the connector body 122. The oval shaped lock sleeve 136 is resiliently distortable for locking the external plug connector 14 and the pass-through connector 12 together. It has two finger grips 138 at opposite ends of the major diameter and two internal nibs 139 at the opposite ends of the minor diameter. The nibs 139 fit into lock holes 35 of the socket 34 of the pass through connector 12 to lock the connectors 12 and 14 together. The nibs 139 are released by squeezing the finger grips 138 toward each other. This distorts the oval shaped lock sleeve 136 into a round shape moving the nibs 139 radially outwardly of the lock holes 35. The finger grips 138 are released after the exterior plug connector 14 is pulled off, whereupon the lock sleeve 136 returns to its normal oval shape. This oval shaped lock sleeve arrangement is well known.

Figure 6:
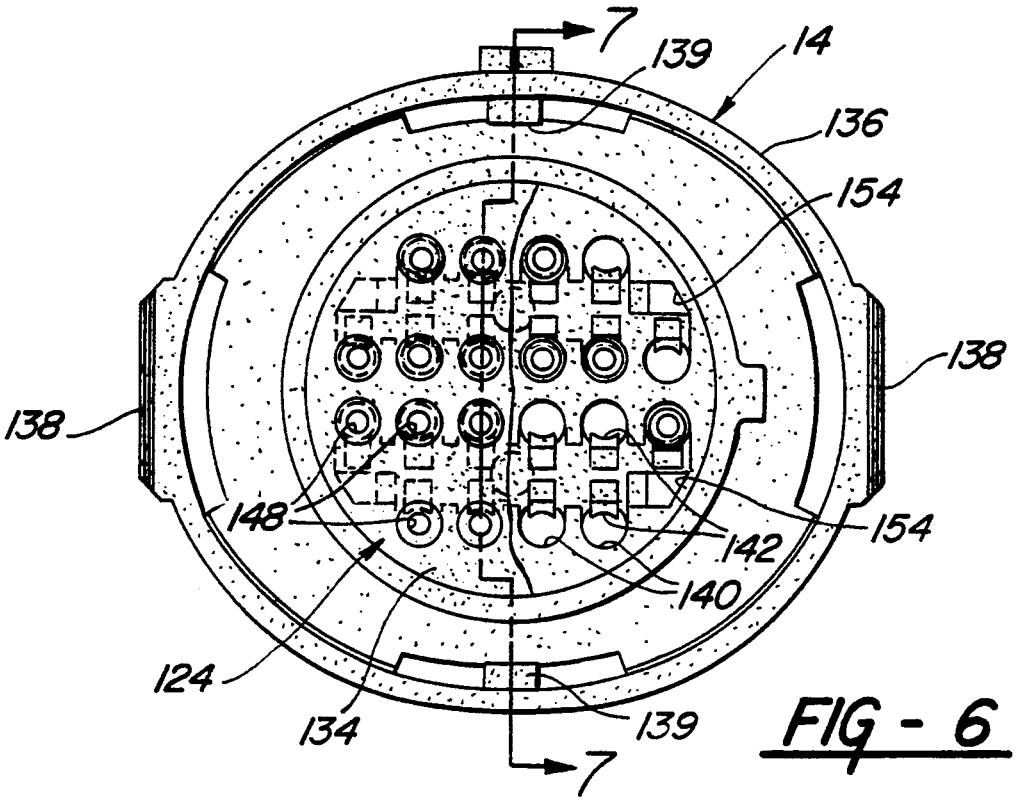
FIG. 6 is a front, partially sectioned view of the mating electrical connector that is shown in FIGS. 1.
Figure 7:
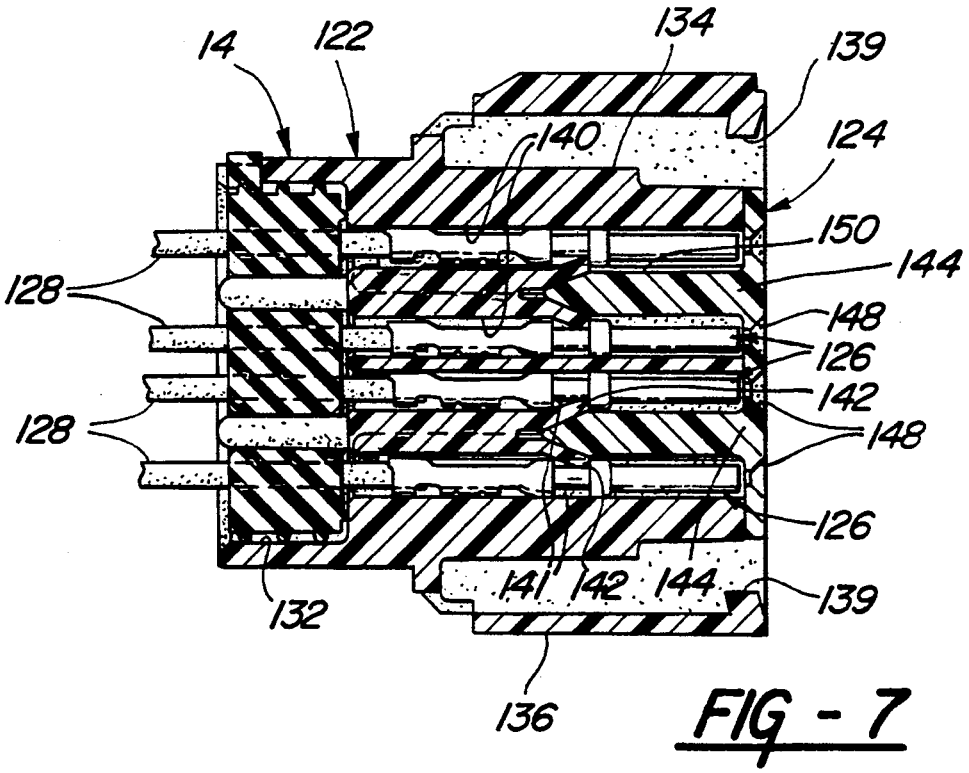
FIG. 7 is a section taken substantially along the line 7—7 of FIG. 6 looking in the direction of the arrows.

The connector body 122 also includes a plurality of terminal cavities 140 that are arranged in four rows as shown in FIG. 6 and that extend through the connector body 122 in the longitudinal direction as shown in FIG. 7. The connector body 122 also has a plurality of resiliently deflectable, latch fingers 142 that are located at the mating ends of the respective terminal cavities 140. When the female terminals 126 are inserted into the terminal cavities 140 through the cable end, the latch fingers 142 snap into circular grooves 141 of the female terminals 126 to retain the terminals 126 in the cavities 140 as shown in FIG. 7.

The latch fingers 142 are also arranged in two dual rows so that two rows of latch fingers 142 are disposed between the upper two rows of terminal cavities 140 and two rows of latch fingers 142 are disposed between the lower two rows of latch fingers 142 as shown in FIGS. 6 and 7. As before, this facilitates a secondary lock for holding the latch fingers 142 in the grooves 141.

The thermoplastic insert 124 is such a secondary lock for holding the latch fingers 142 in terminal latching positions in the circular grooves 141 of the female terminals 126. The insert 124 comprises a thermoplastic disk body in the form of a disc 144 covers the contact end of the plug portion 134 of the connector body 122 as shown best in FIGS. 6 and 7. The disk 144 has a plurality of holes 148 that align with the respective terminal cavities 140 when the insert 124 is installed. The disk shaped body 144 also has two transverse wedge shaped ribs 150. The wedge shaped ribs 150 fit into slots 146 in the contact end of the plug 134 and engage between the two rows of terminal latch fingers 142 in the respective dual rows and wedge the terminal latch fingers 142 in the two respective rows away from each other to hold the latch fingers 142 in the circular terminal grooves 141 as best shown in FIG. 7.

The insert 124 also has four rectangular posts 152 that extend longitudinally from the disk 144 in the rearward direction. These posts 152 are disposed in trapezoidal passages 154 of the connector body 122 that have resiliently deflectable latch fingers at the cable end. The deflectable latch fingers engage notches 156 in the free ends of the posts 152 to retain the insert 124 in installed position as shown in FIGS. 6 and 7.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

We claim:

1. A two-piece male pin terminal comprising:

a contact member that is made of an electrically conductive material and an attachment member;

the contact member having a round solid pin at one end that has a round point to facilitate insertion of the male pin terminal into terminal cavities and through an elastomeric seal so that it seals around the round solid pin;

the medial portion of the contact member having an integral collar; and the opposite end of the contact member having a round clamping section behind the collar and a flattened end, and the attachment member having a cylindrical attachment portion at one end that has a hollow circular rib at one end that is formed around the collar and a section that is clamped around the clamping section of the contact member tightly, the attachment member having a cable attachment means at the other end, and the flattened end of the contact member being disposed in the cable attachment means of the attachment member so that it engages the core of the electric cable when the two-piece terminal is attached to the electric cable by the attachment member.

2. A two-piece male pin terminal comprising:

a solid metal contact member and a formed sheet metal attachment member that are made of an electrically conductive material;

the solid metal contact member having a smooth round pin at one end that has a round point to facilitate insertion of the terminal through terminal cavities, sealing holes and membranes;

the medial portion of the contact member having an integral collar; and the opposite end of the contact member having a round clamping section behind the collar and a flattened dished end that is knurled on its upper concave surface; and the sheet metal attachment member having a cylindrical attachment portion at one end that has a hollow circular rib at one end that is formed around the collar and a hollow circular rib at the other end that is spaced from the hollow circular rib to form a circular locking groove, the section of the cylindrical attachment portion between the hollow ribs and being clamped around the clamping section of the solid metal contact member tightly, the sheet metal attachment member having a medial transition neck and a core and insulation crimp portion at the other end that is formed into a open U-shaped channel for receiving an electric cable, and the flattened dished end of the solid pin member lying in the bottom of the open channel so that the core of the electric cable is pressed against the upper knurled surface of the flattened dished end when the open channel is crimped about the insulation stripped end of an electric cable.

* * * * *